US007566208B2

(12) United States Patent
Santos

(10) Patent No.: US 7,566,208 B2
(45) Date of Patent: Jul. 28, 2009

(54) NON-ELECTRIC DRIVE MECHANISM FOR A SUBMERSIBLE PUMP

(75) Inventor: Enrique C. Santos, Edmonton (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 455 days.

(21) Appl. No.: 11/164,037

(22) Filed: Nov. 8, 2005

(65) Prior Publication Data

US 2007/0104594 A1 May 10, 2007

(51) Int. Cl.
*F04B 17/04* (2006.01)
*F04B 35/04* (2006.01)

(52) U.S. Cl. ..... 417/365; 417/390; 417/392; 417/409; 415/80; 415/106; 92/181 R

(58) Field of Classification Search ..... 417/390, 417/406, 407, 408, 409
See application file for complete search history.

(56) References Cited

U.S. PATENT DOCUMENTS 1,739,000 A * 12/1929 Jordao, Jr. ..... 417/91
2,726,606 A * 12/1955 Davidson ..... 417/247
3,976,390 A * 8/1976 Silvern et al. ..... 415/58.1
6,234,770 B1 * 5/2001 Ridley et al. ..... 417/408
6,393,208 B1 5/2002 Nosenchuck

FOREIGN PATENT DOCUMENTS

CA 2060955 A1 8/1992
CA 2142925 A1 12/1995
WO 02/13652 A1 2/2002

* cited by examiner

*Primary Examiner*—Devon C Kramer
*Assistant Examiner*—Patrick Hamo
(74) *Attorney, Agent, or Firm*—Kevin Brayton McGoff, atty

(57) ABSTRACT

A non-electric drive mechanism connectable to a submersible pump for pumping a fluid from a wellbore to the surface, the drive mechanism including a shaft rotatably disposed within a housing, the shaft operationally connectable to the submersible pump, at least one fan connected to the shaft and a supply manifold positioned to pass a pressurized fluid across the at least one fan in a manner to rotate the fan and the shaft.

15 Claims, 3 Drawing Sheets

NON-ELECTRIC DRIVE MECHANISM FOR A SUBMERSIBLE PUMP

FIELD OF THE INVENTION

The present invention relates in general to downhole submersible pump systems and more particularly to a non-electric drive mechanism for a submersible pump.

BACKGROUND

Submersible pumping systems have been employed in the pumping of oil and water from wells for many years. Typically, a submersible pumping system comprises an electric motor, a motor protector, and a centrifugal pump suspended co-linearly in a well casing by tubing or a cable. The electric motor rotates a power transmission shaft that concurrently operates the pump. The electric motor and motor protector are filled with oil to aid in heat dissipation, to maintain proper internal lubrication of the motor, and to separate the internal components of the motor from the surrounding wellbore fluids. The electric motor requires the provision of electricity to the motor positioned in the wellbore and surrounding fluids, and the motor protector needs to protect the electric motor by equalizing wellbore pressure and sealing against wellbore fluids entering the electric motor.

Therefore, it is a desire to provide a drive mechanism that addresses the drawbacks of the prior art electric motors utilized in submersible pump systems. It is a still further desire to provide a novel drive mechanism to replace the prior art electric motor and associated required equipment in a submersible pump system.

SUMMARY OF THE INVENTION

In view of the foregoing and other considerations, the present invention relates to submersible pump systems. More particularly the present invention relates to a non-electric drive mechanism for a submersible pump.

Accordingly, a non-electric drive mechanism connectable to a submersible pump for pumping a fluid from a wellbore to the surface is provided. In an embodiment of the present invention the drive mechanism includes a shaft rotatably disposed within a housing, the shaft operationally connectable to the submersible pump, at least one fan connected to the shaft and a supply manifold positioned to pass a pressurized fluid across the at least one fan in a manner to rotate the fan and the shaft.

The drive mechanism may include a gear box in functional connection with the shaft to reduce or amplify the rotational speed transmitted to the submersible pump. The drive mechanism may include a thrust bearing in functional connection with the shaft and a thrust runner in functional connection with the shaft.

In another embodiment of the present invention the drive mechanism includes a substantially cylindrical housing, a shaft rotatably disposed within the housing, the shaft operationally connectable to the submersible pump and at least one fan connected to the shaft. A supply manifold positioned to pass a pressurized fluid across the at least one fan in a manner to rotate the fan and the shaft wherein the supply manifold is connectable to a source of a pressurized fluid, and an exhaust manifold for removing the pressurized fluid from the housing. A thrust bearing in functional connection with the shaft and a thrust runner in functional connection with the shaft.

An embodiment of a non-electric drive mechanism submersible pump system for pumping a fluid from a wellbore to the surface includes a centrifugal submersible pump and a drive mechanism in operational connection with the centrifugal pump. The drive mechanism includes a substantially cylindrical housing, a shaft rotatably disposed within the housing wherein the shaft is operationally connectable to the submersible pump and at least one fan connected to the shaft. A supply manifold is positioned to pass a pressurized fluid across the at least one fan in a manner to rotate the fan and the shaft and an exhaust manifold for removing the pressurized fluid from the housing. The supply manifold is connectable to a source of a pressurized fluid.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
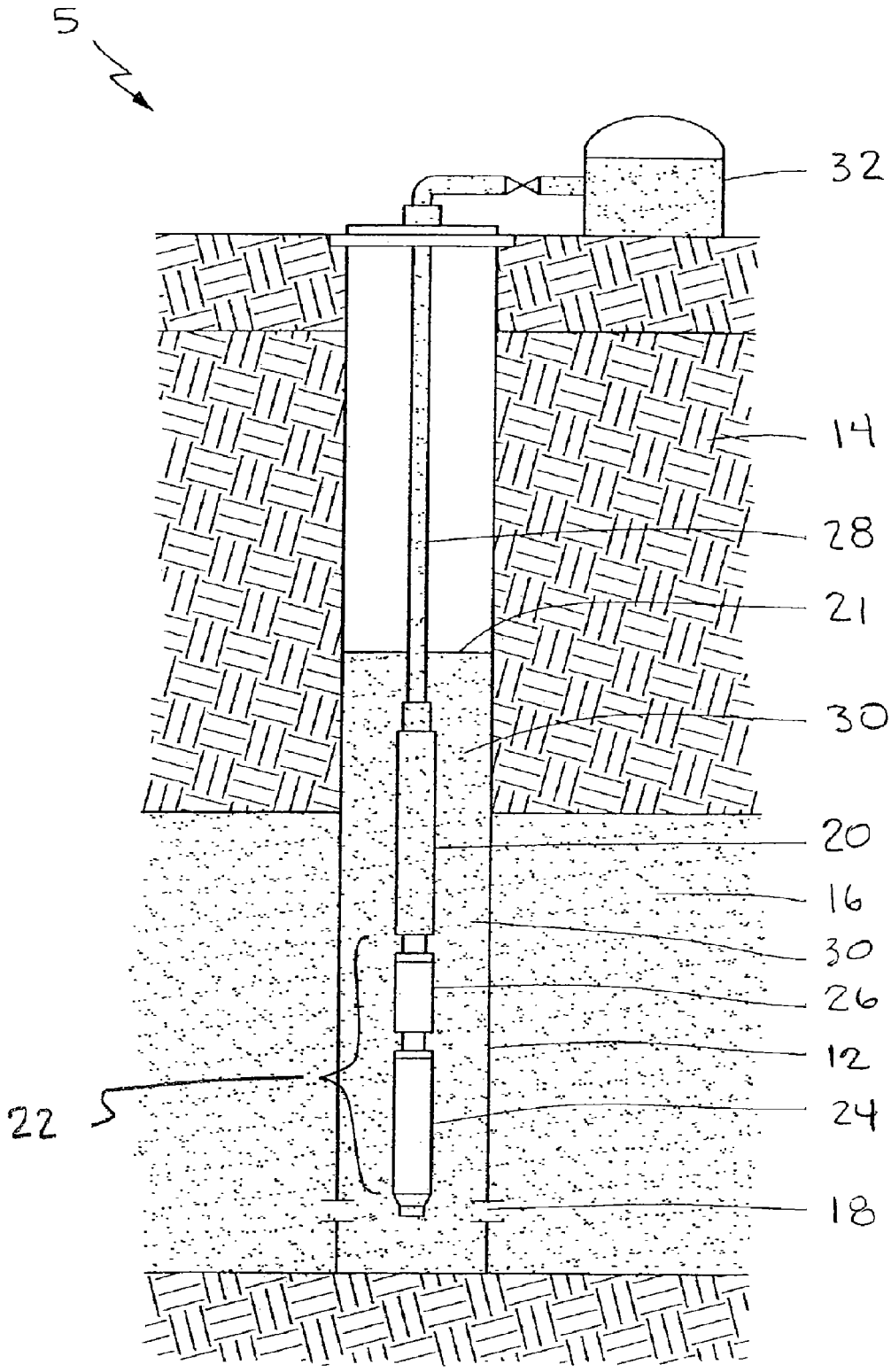
Fig. 1 (Prior Art)
FIG. 1 is a well schematic of a typical prior art submersible pump system.

Refer now to the drawings wherein depicted elements are not necessarily shown to scale and wherein like or similar elements are designated by the same reference numeral through the several views.

FIG. 1 is a well schematic of a typical prior art submersible pump system, generally denoted by the numeral 5. A casing 12 is set in a wellbore formed into the earth 14 and a fluid producing formation 16. Perforations 18 are formed through casing 12 to facilitate the flow of fluid from producing formation 16 into casing 12.

The prior art submersible pump system 5 includes a centrifugal pump 20 and motor assembly 22. Motor assembly 22 includes an electric motor 24 and a motor protector 26. Motor protector 26 equalizes well pressure, prevents well fluid contamination of electric motor 24 and absorbs the thrust load transmitted from pump 20. Electric power is provided to electric motor 24 by an electrical cable (not shown).

Centrifugal pump 20 and motor assembly 22 are coupled to one another co-linearly within casing 12 by tubing 28. Pump 20 is positioned below wellbore fluid level 21 and conveys wellbore fluid 30 via tubing 28 to a storage facility 32 at the surface.

Figure 2:
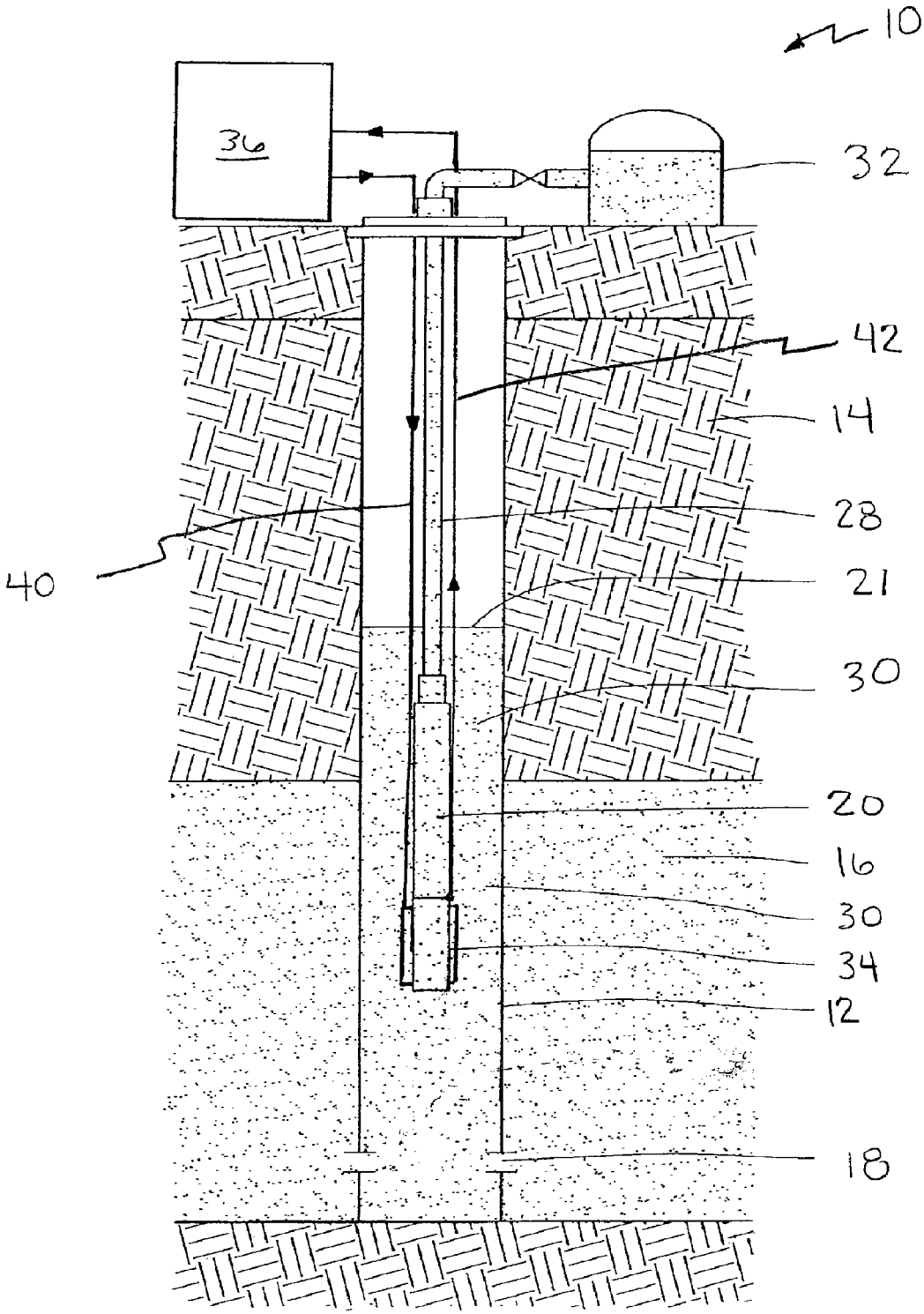
FIG. 2 is a well schematic of an embodiment of the non-electric drive submersible pump system of the present invention.

FIG. 2 is a well schematic of an embodiment of the non-electric drive submersible pump system of the present invention, generally denoted by the numeral 10. Pump system 10 includes a centrifugal pump 20 and a non-electric drive mechanism 34. Pump 20 and drive mechanism 34 are coupled to one another co-linearly within casing 12 by tubing 28.

Drive mechanism 34 is powered by a pressurized fluid. Desirably the pressurized fluid is a gas such as, but not limited to, steam, air, nitrogen or natural gas. Pressurized gas is supplied to drive mechanism 34 from a surface facility 36 via a supply conduit 40. The spent pressurized fluid may be returned to the surface via a return conduit 42 for venting, storage and/or recycling. Conduits 40 and 42 may be formed by any suitable conduit such as, but not limited to, a seamless, continuous tubing such as coiled tubing.

Surface facility 36 is described broadly to include any necessary and desired equipment to supply a fluid at the desired pressure, volume and quality and for treatment of the gas returned from drive mechanism 34. For example, when the pressurized gas is steam, surface facility 36 may include a steam generator and associated water treatment plant. Further, in steam injection operations the steam for operating drive mechanism 34 may be slipped from a steam injection line. For receiving the returned steam, surface facility 36 may include storage tanks and/or vent lines. For compressed air, the system may include storage vessels, compressors, pumps, dehydration units and booster stations. Similar equipment and facilities may be incorporated for the use of other inert gasses or natural gas available at the well site. It should be recognized that the pressurized fluid returned from drive mechanism 34 may be recycled, recirculated through drive mechanism 34 or vented.

As can be seen through FIGS. 1 and 2, the non-electric drive mechanism 34 of the present invention eliminates electric motor 24, the electrical supply cable, motor protector 26 and the associated drawbacks of the current and prior art electrical submersible pump systems.

Figure 3:
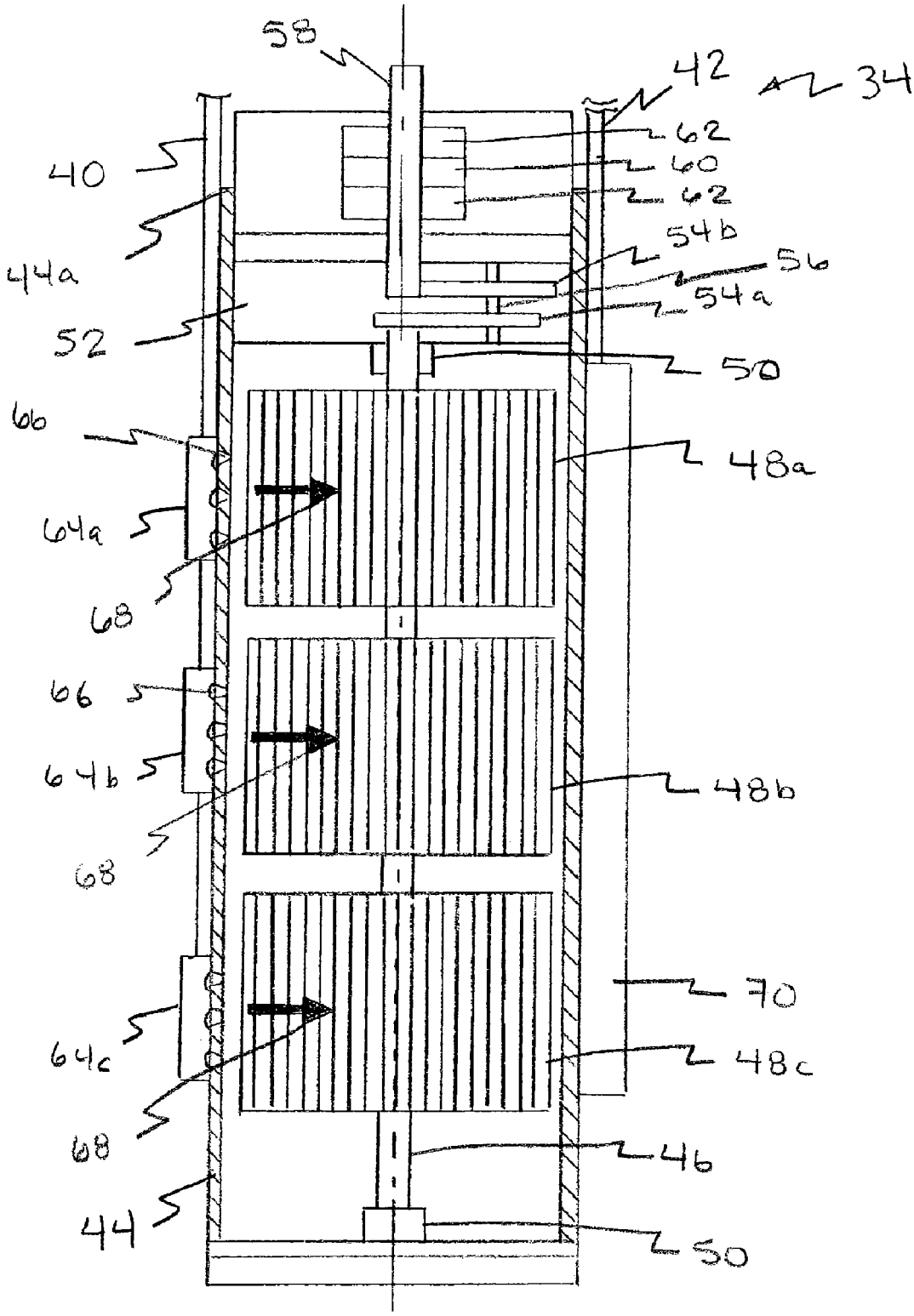
FIG. 3 is a partial, cross-sectional view of an embodiment of the drive mechanism of the present invention.

FIG. 3 provides a partial, cross-sectional view of an embodiment of drive mechanism 34 of the present invention. Drive mechanism 34 includes a substantially cylindrical housing 44 and a fan shaft 46 connected to one or more fan sections 48. Fan shaft 46 is operationally connected to the drive shaft of pump 20 (FIG. 2). The top end 44*a* is adapted for connecting to pump 20. Fan shaft 46 is mounted within housing 44 via bearings 50 to provide rotating operation and radial support of fan shaft 46.

Fan sections 48 are connected along the keyed fan shaft 46 such that fan sections 48 can rotate fan shaft 46. Drive mechanism 34 may include one or more fan sections 48. As shown in the present example, drive mechanism 34 includes three fan sections 48*a*, 48*b*, 48*c*. Fan sections 48 may each comprise a cylindrical blower fan configuration.

Pressurized fluid is provided to drive mechanism 34 via supply conduit 40 through one or more supply manifolds 64. Supply manifold 64 may include an orifice 66 for passing the pressurized fluid, indicated by arrows 68, across fans 48. In the embodiment of FIG. 3, a supply manifold 64*a*, 64*b*, 64*c* is positioned proximate each fan section 48*a*, 48*b*, 48*c* respectively.

Flow of pressurized fluid 68 across fan sections 48 rotates fan sections 48 and fan shaft 46. This rotation is transmitted to connected pump 20. The speed of rotation of fan sections 48 and fan shaft 46 may be controlled by the volume and/or pressure of fluid 68. Pressurized fluid 68 is removed from housing 44 via one or more exhaust manifolds 70 connected to return conduit 42. Although exhaust manifold 70 is shown in FIG. 3 positioned opposite supply manifolds 64 relative to housing 44 it should be recognized that exhaust manifold 70 may be located in various positions including adjacent supply manifolds 64, incorporated as a section of supply manifold(s) 64, and at the top and/or bottom end of drive mechanism 34.

Drive mechanism 34 may further include a sealed gear box 52. The rotation of fan sections 48*a*, 48*b*, 48*c* is transmitted to fan shaft 46 to gears 54 to reduce or amplify the rotational speed. The resultant rotational speed of gear train 56 is transmitted to drive shaft 58. Drive shaft 58 may be the shaft of pump 20 (FIG. 2) or coupled to the shaft of pump 20. Gear box 52 is sealed to prevent contamination of the gear oil and avoid premature failure of gears 54 and the bearings.

Thrust bearings 62 for the pumps may be in connection with drive shaft 58. A thrust runner 60 may also be coupled with drive shaft 58. It should be recognized that in various embodiments thrust runner 60 and thrust bearings may be connected to fan shaft 46, for example when gear box 52 is not incorporated. It should be further recognized that fan shaft 46 is effectively the drive shaft for pump 20 when all elements are coupled.

From the foregoing detailed description of specific embodiments of the invention, it should be apparent that a non-electric drive mechanism submersible pump system and more particularly a non-electric drive mechanism for a submersible pump that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A drive mechanism connectable to a submersible pump for pumping a fluid from a wellbore to the surface, the drive mechanism comprising:

a housing;

a shaft rotatably disposed within the housing, the shaft operationally connectable to the submersible pump;

at least one fan connected to the shaft and disposed in the wellbore; and a supply manifold positioned to pass a pressurized fluid across the at least one fan in a manner to rotate the fan and the shaft;

a conduit connecting from the surface to the supply manifold that transports the pressurized fluid from the surface to the supply manifold;

further including a gear box in functional connection with the shaft to reduce or amplify the rotational speed of the shaft transmitted to the submersible pump.

2. The drive mechanism of claim 1, wherein the housing is substantially cylindrical.

3. The drive mechanism of claim 1, wherein the housing is co-linearly connectable to the submersible pump.

4. The drive mechanism of claim 1, wherein the at least one fan is configured as a blower fan.

5. The drive mechanism of claim 1, further including an exhaust manifold removing the pressurized fluid from the housing.

6. The drive mechanism of claim 1, further including:

a thrust bearing in functional connection with the shaft; and a thrust runner in functional connection with the shaft.

7. A drive mechanism connectable to a submersible pump for pumping a fluid from a wellbore to the surface, the drive mechanism comprising:

a substantially cylindrical housing;

a shaft rotatably disposed within the housing, the shaft operationally connectable to the submersible pump;

at least one fan connected to the shaft and disposed in the wellbore;

a supply manifold positioned to pass a pressurized fluid across the at least one fan in a manner to rotate the fan and the shaft, the supply manifold connectable to a source of a pressurized fluid;

a conduit connecting from the surface to the supply manifold that transports the pressurized fluid from the surface to the supply manifold:

an exhaust manifold for removing the pressurized fluid from the housing;

a thrust bearing in functional connection with the shaft; and a thrust runner in functional connection with the shaft;

further including a gear box in functional connection with the shaft to reduce or amplify the rotational speed of the shaft transmitted to the submersible pump.

8. The drive mechanism of claim 7, wherein the pressurized fluid is a pressurized gas.

9. The drive mechanism of claim 8, wherein the pressurized gas is steam.

10. A submersible pump system for pumping a fluid from a wellbore to the surface, the system comprising:

a centrifugal submersible pump; and a non-electric drive mechanism in operational connection with the centrifugal pump, the drive mechanism including:

a substantially cylindrical housing;

a shaft rotatably disposed within the housing, the shaft operationally connectable to the submersible pump;

at least one fan connected to the shaft and disposed in the wellbore;

a supply manifold positioned to pass a pressurized fluid across the at least one fan in a manner to rotate the fan and the shaft, the supply manifold connectable to a source of a pressurized fluid;

a conduit connecting from the surface to the supply manifold that transports the pressurized fluid from the surface to the supply manifold: and an exhaust manifold for removing the pressurized fluid from the housing;

further including a gear box in functional connection with the shaft to reduce or amplify the rotational speed of the shaft transmitted to the submersible pump.

11. The system of claim 10, wherein the pressurized fluid is a pressurized gas.

12. The system of claim 10, wherein the pressurized fluid is steam.

13. The system of claim 10, wherein the at least on fan is configures as a blower fan.

14. The system of claim 11, wherein the at least on fan is configures as a blower fan.

15. The system of claim 10, further including:

a thrust bearing in functional connection with the shaft; and a thrust runner in functional connection with the shaft.

* * * * *